US007909634B2

(12) United States Patent
Enomoto et al.

(10) Patent No.: US 7,909,634 B2
(45) Date of Patent: Mar. 22, 2011

(54) ELECTRICAL CONNECTION STRUCTURE OF A CONNECTING TERMINAL

(75) Inventors: Noritsugu Enomoto, Tokyo (JP); Shigeki Motomura, Tokyo (JP); Takenobu Yabu, Tokyo (JP)

(73) Assignees: Furukawa Electric Co., Ltd., Tokyo (JP); Furukawa Automotive Systems, Inc., Shiga (JP)

( * ) Notice: Subject to any disclaimer, the term of this patent is extended or adjusted under 35 U.S.C. 154(b) by 0 days.

(21) Appl. No.: 12/670,061

(22) PCT Filed: Jul. 22, 2008

(86) PCT No.: PCT/JP2008/001950

§ 371 (c)(1),
(2), (4) Date: Jan. 21, 2010

(87) PCT Pub. No.: WO2009/013895

PCT Pub. Date: Jan. 29, 2009

(65) Prior Publication Data

US 2010/0197164 A1 Aug. 5, 2010

(30) Foreign Application Priority Data

Jul. 24, 2007 (JP) ..... 2007-191935

(51) Int. Cl.
*H01R 4/24* (2006.01)

(52) U.S. Cl. ..... 439/443

(58) Field of Classification Search ..... 439/443, 439/395, 444, 404, 492
See application file for complete search history.

(56) References Cited

U.S. PATENT DOCUMENTS 6,478,612 B2 * 11/2002 Okano ..... 439/495
(Continued)

FOREIGN PATENT DOCUMENTS

JP 117648/1978 3/1980
(Continued)

OTHER PUBLICATIONS

International Search Report mailed Sep. 9, 2008 for PCT Application No. PCT/JP2008/001950, 4 pages.

*Primary Examiner* — Chandrika Prasad
(74) *Attorney, Agent, or Firm* — Turocy & Watson, LLP

(57) ABSTRACT

An objective is to provide a connection structure of a connecting terminal by which it becomes able to perform a connection of any of pieces for piercing as assuredly without being bended that is piercing through an electrically conductive flat square body, and to provide a method of connecting such the terminal. A unit for connecting a pierced terminal (1) comprises a pierced terminal (20) which comprises a plurality of blades on a pierced terminal (21) that are designed to pierce individually through a flat cable (100) and which is designed to be connected as electrically to such the flat cable (100) due to each of such the blades on the pierced terminal (21) that is piercing therethrough; and a back up plate (30) which comprises an opening for insertion (31) by which an insertion of any of the blades on the pierced terminal (21) is allowed that is piercing through the flat cable (100), wherein such the opening for insertion (31) is designed to be contacted to individual corresponding parts of such the blades on the pierced terminal (21) as not less than two pieces that are facing to each other and that are individually inserted into such the opening for insertion (31), respectively.

10 Claims, 10 Drawing Sheets

U.S. PATENT DOCUMENTS

| | | | | |
|---|---|---|---|---|
| 7,347,716 | B2 * | 3/2008 | Oesterhaus et al. | 439/404 |
| 2008/0153346 | A1 * | 6/2008 | Oesterhaus et al. | 439/499 |

FOREIGN PATENT DOCUMENTS

| | | | |
|---|---|---|---|
| JP | 2001-210411 | A | 8/2001 |
| JP | 2002-246091 | A | 8/2002 |
| JP | 2002-313150 | A | 10/2002 |
| JP | 2003-142796 | | 5/2003 |
| JP | 2003-297468 | A | 10/2003 |
| JP | 2004-071180 | A | 3/2004 |
| JP | 2004-103447 | A | 4/2004 |
| JP | 2004-241268 | A | 8/2004 |
| JP | 2004-311133 | A | 11/2004 |
| JP | 2005-122901 | A | 5/2005 |

* cited by examiner

ELECTRICAL CONNECTION STRUCTURE OF A CONNECTING TERMINAL

CROSS-REFERENCE TO RELATED APPLICATIONS

This application is a US national stage filing of patent cooperation treaty (PCT) Appln. No. PCT/JP2008/001950 (WO 2009/013895), filed Jul. 22, 2008, which claims priority to Japanese patent application No. 2007-191935, filed on Jul. 24, 2007, the entire content of which are incorporated herein by reference.

TECHNICAL FIELD

The present invention relates to a connection structure of a connecting terminal, in which a plurality of pieces for piercing are designed to be provided that individually pierce such as an electrically conductive flat square body or the like respectively.

BACKGROUND ART

Conventionally, a connection structure is proposed in order to connect an electronic part or component to an electrically conductive flat square body, such as a flat cable or the like (refer to the following Patent Document 1). And then such the connection structure is designed to be as a structure in which a flexible line circuit body as the electrically conductive flat square body is stabbed by a crimp piece in a connector and then thereby being pierced, and in which the same is fixed by bend forming and then by riveting a part that is pierced out from such the crimp piece which is mentioned above. However, such the connection structure has a probability to become difficult to perform such the bend formation of the crimp piece, due to the connector that becomes to be smaller in size in response to the electronic parts and components for which it is required to be smaller in size.

Patent Document 1: Japanese Patent Application Publication No. 2003-142796.

DISCLOSURE OF THE INVENTION

Problems to be Solved by the Invention

An objective of the present invention is to provide a connection structure of a connecting terminal by which it becomes able to perform a connection of any of pieces for piercing as assuredly without being bended that is piercing an electrically conductive flat square body, and to provide a method of connecting such the terminal.

Means for Solving the Problems

According to the present invention in the first instance, a connection structure of a connecting terminal is characterized in that comprises: a connecting terminal, in which a plurality of pieces for piercing are designed to be provided that individually pierce through an electrically conductive flat square body respectively, and which is designed to be connected as electrically to the electrically conductive flat square body due to each of the pieces for piercing that is piercing therethrough respectively; and a plate that comprises an opening for insertion into which an insertion of any of the pieces for piercing is allowed that is piercing through the electrically conductive flat square body respectively, wherein the opening for insertion is designed to be contacted to individual corresponding parts that are facing to each other on the individual corresponding pieces for piercing as not less than two pieces that are individually inserted into the opening for insertion, respectively.

As another aspect according to the present invention, it becomes able to design each of the pieces for piercing to be formed into a shape of a thin plate that has a face as approximately parallel in a length direction and in a piercing direction, and it becomes able to design a plurality of the pieces for piercing to be arranged in the length direction, and it becomes able to design either one face of the piece for piercing to be contacted to a face at an inner side of the opening for insertion.

Moreover, as further another aspect according to the present invention, the connection structure of the connecting terminal according to the above mentioned second aspect is characterized in that it becomes able to design a predetermined gap to be formed at an opposite side that corresponds to a side for contact of the piece for piercing at a state where any of the pieces for piercing is inserted into the opening for insertion respectively. As still further another aspect according to the present invention, the connection structure of the connecting terminal according to either one of the second aspect or the third aspect is characterized in that it becomes able to design a plurality of the pieces for piercing that are arranged in the length direction and/or the openings for insertion that individually correspond to each of the pieces for piercing to be performed a staggered arrangement with having a predetermined spacing in a cross direction respectively.

As another aspect according to the present invention, the connection structure of the connecting terminal according to any one of the aspects from the first to the fourth is characterized in that the connection structure of the connecting terminal further comprises: a holder for holding the connecting terminal in order to hold the connecting terminal; and a holding plate in order to hold the plate as removable in a direction as right angle to the piercing direction, and that it becomes possible to design the holder for holding the connecting terminal and the holder for holding the plate to be set in each other by arranging the electrically conductive flat square body therebetween.

Furthermore, according to the present invention, a method of connecting the connecting terminal is characterized in that comprises the following steps of: installing a connecting terminal, in which a plurality of pieces for piercing are designed to be provided that individually pierce through an electrically conductive flat square body respectively, and which is designed to be connected as electrically to the electrically conductive flat square body due to each of the pieces for piercing that is piercing therethrough respectively, into a holder for holding the connecting terminal in order to hold the connecting terminal; installing a plate, that comprises an opening for insertion into which an insertion of any of the pieces for piercing is allowed that is piercing through the electrically conductive flat square body respectively, into a holder for holding the plate in order to hold the plate as removable in a direction as right angle to the piercing direction; and setting in the holder for holding the connecting terminal and the holder for holding the plate each other, by inserting the electrically conductive flat square body into between the holder for holding the connecting terminal and the holder for holding the plate, and then by arranging the electrically conductive flat square body therebetween.

Effects of the Invention

And therefore in accordance with the present invention, it becomes able to provide the connection structure of the connecting terminal by which it becomes able to perform the connection of any of the pieces for piercing as assuredly without being bended that is piercing through the electrically conductive flat square body, and it becomes able to provide the method of connecting such the terminal.

BRIEF DESCRIPTION OF THE REFERENCE SYMBOLS

10: HOLDER FOR HOLDING A PIERCING TERMINAL
20: PIERCING TERMINAL
21: BLADE ON A PIERCING TERMINAL
21A: LATERAL FACE
30: BACK UP PLATE
31: OPENING FOR INSERTION
31B: INNER SIDE FACE
32: CONTINUOUS OPENING FOR INSERTION
40: HOLDER FOR HOLDING A PLATE
102: ELECTRICALLY CONDUCTIVE FLAT BODY FOR WIRING
X: LENGTH DIRECTION
Y: CROSS DIRECTION
Z: PIERCING DIRECTION

BEST MODE FOR CARRYING OUT THE INVENTION

A connection of a piercing terminal (20) to a flat cable (100) and a unit for connecting a piercing terminal (1) will be described in detail below, that are one embodiment in accordance with the present invention, in reference to FIG. 1 through FIG. 6. And, unit for connecting the piercing terminal (1) is designed to be as a unit in order to connect a piercing terminal (20) to a flat cable (100).

Figure 1:
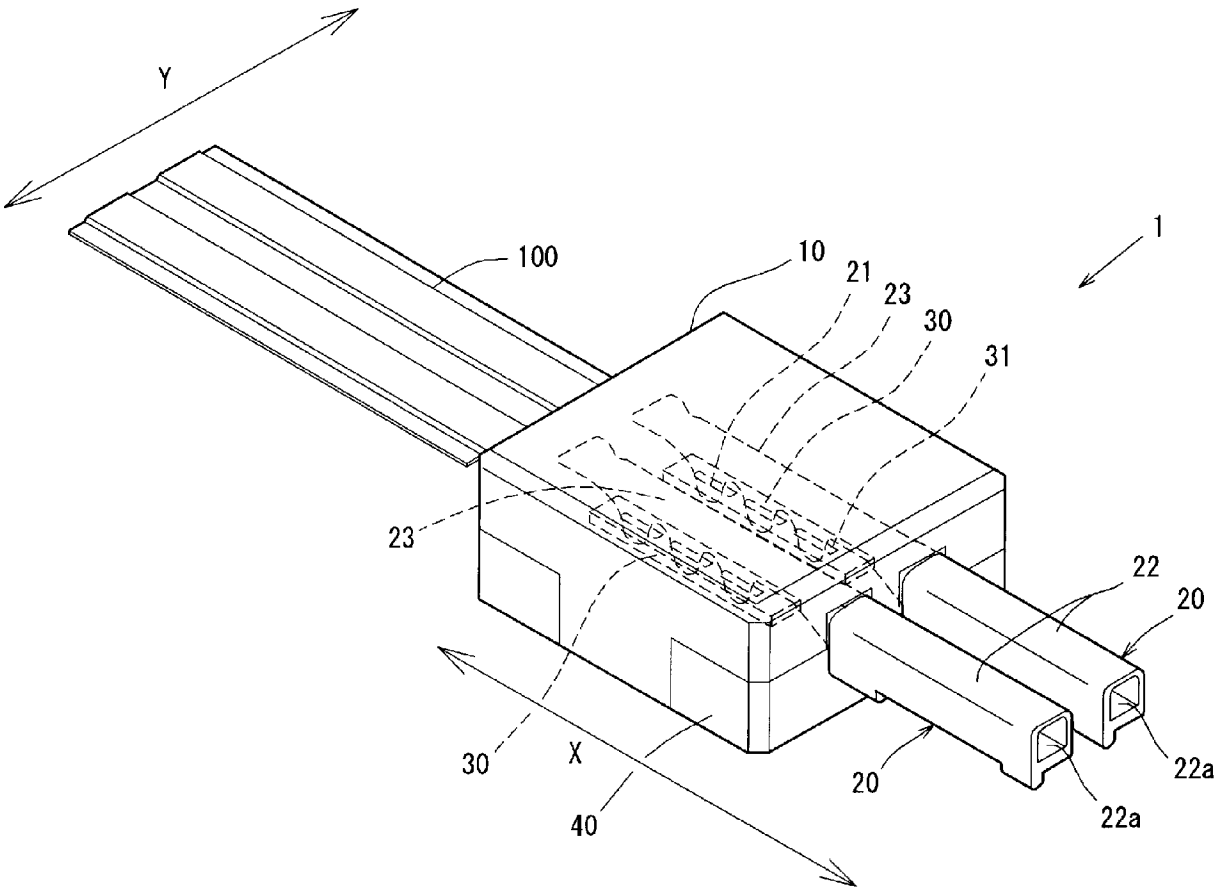
FIG. 1 is a diagrammatic perspective view showing a state of which a unit for connecting a piercing terminal is connected to a flat cable.
Figure 2:
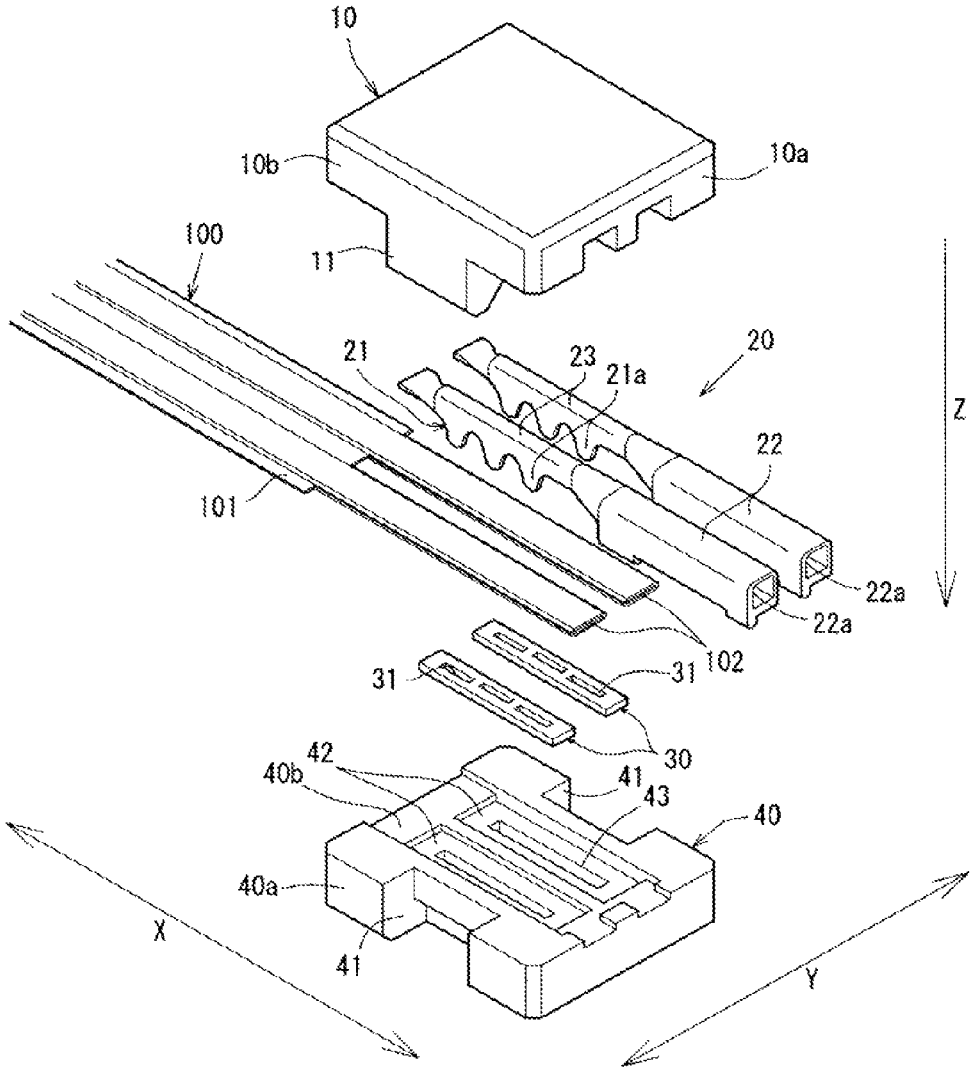
FIG. 2 is a diagrammatic perspective exploded view showing a unit for connecting a piercing terminal.
Figure 3:
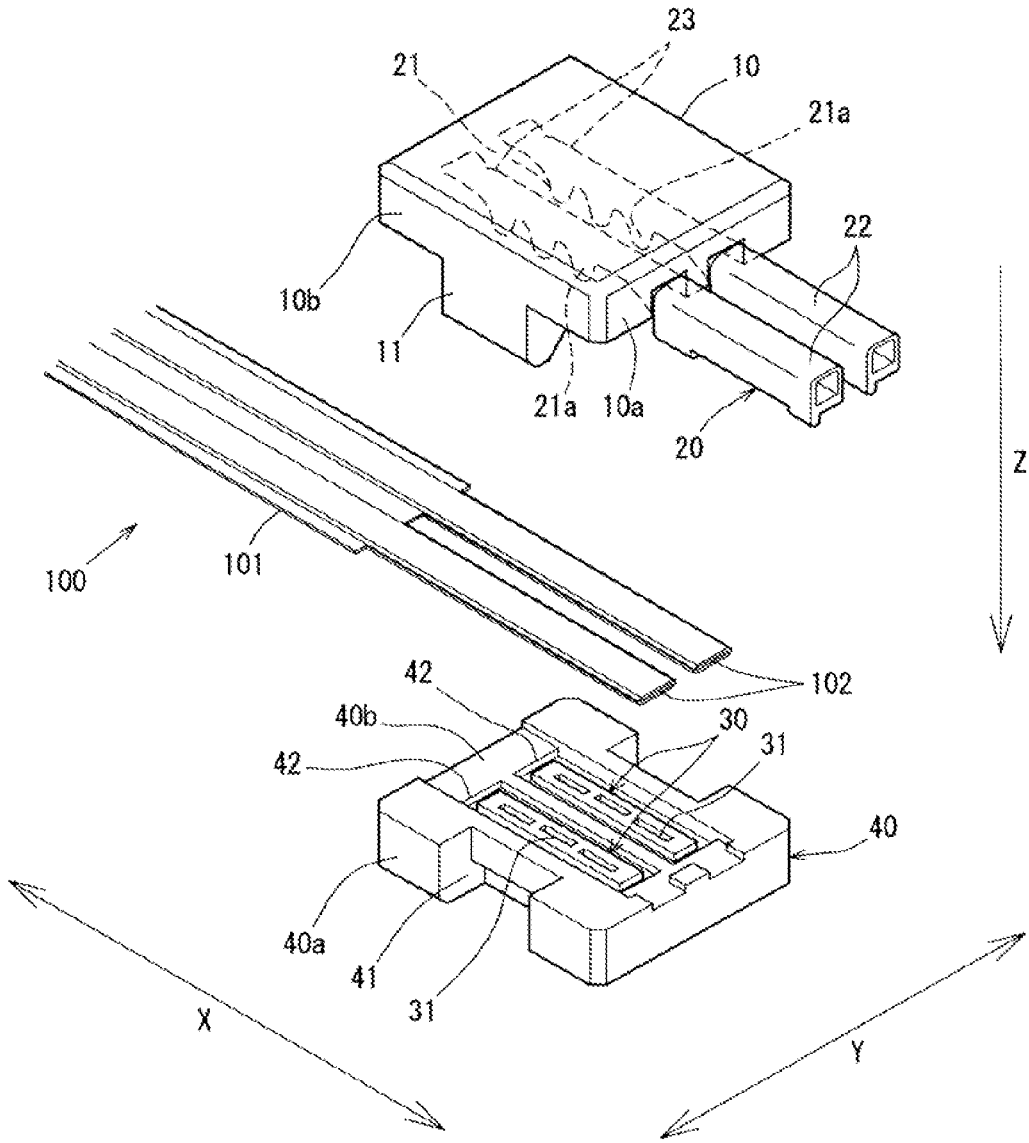
FIG. 3 is an explanatory drawing showing a method of assembling a unit for connecting a piercing terminal.

Moreover, the unit for connecting the piercing terminal (1) is designed to comprise: a holder for holding a piercing terminal (10) in order to hold the piercing terminal (20); and a holder for holding a plate (40) in order to hold a back up plate (30) as removable in a direction as right angle to a piercing direction (Z), that is to say, in a length direction (X) and in a cross direction (Y), that are shown in FIG. 1 through FIG. 3. Further, in accordance with the unit for connecting the piercing terminal (1), the holder for holding the piercing terminal (10) and the holder for holding the plate (40) are designed to be set in each other, the flat cable (100) is designed to be arranged therebetween, and then the piercing terminal (20) is designed to be fitted in to the flat cable (100).

Here, FIG. 1 shows from a diagrammatic perspective view regarding a state of which the unit for connecting the piercing terminal (1) is connected to the flat cable (100). In the meantime, FIG. 2 shows from a diagrammatic perspective exploded view regarding the unit for connecting the piercing terminal (1). And in the meantime, FIG. 3 shows an explanatory drawing from a diagrammatic perspective view in order to explain by making use of the diagrammatic perspective view regarding a method of assembling the unit for connecting the piercing terminal (1).

And then the piercing terminal (20) is designed to comprise a plurality of blades on the piercing terminal (21) that is designed to pierce through an electrically conductive flat body for wiring (102), and that is designed to be connected as electrically to the electrically conductive flat body for wiring (102) due to each of the blades on the piercing terminal (21) that is piercing therethrough. Moreover, each of the blades on the piercing terminal (21) is designed to be formed into a shape of a thin plate that has a lateral face (21A) as approximately parallel in the length direction (X) and in the piercing direction (Z), and a plurality of the blades are designed to be arranged in the length direction (X).

Further, the back up plate (30) is designed to comprise an opening for insertion (31) by which an insertion of any of the blades on the piercing terminal (21) is allowed which is piercing through the electrically conductive flat body for wiring (102). And then the opening for insertion (31) is designed to form a predetermined gap at an opposite side that corresponds to a side for contact of the individual blades on the piercing terminal (21) at a state where any of the individual blades on the piercing terminal (21) is inserted into the opening for insertion (31), respectively. Still further, a plurality of the openings for insertion (31) are designed to be arranged in the length direction (X), and then the same are designed to be performed a staggered arrangement with a predetermined spacing (w) in the cross direction (Y).

Furthermore, each of the lateral faces (21A), that are facing to each other, are designed to be contacted to an inner side face (31B) of each of the corresponding openings for insertion (31) respectively, and that are on at least two of the individual blades on the piercing terminal (21) that are inserted into the individual corresponding openings for insertion (31), that are designed to be configured in manner.

As described in further detail below, the flat cable (100) is designed to be as a flexible flat cable of a flexible flat shape for which two pieces of the electrically conductive flat bodies for wiring (102) individually as a shape of a thin plate are designed to be provided at an inner side of a flat insulating body (101). And then in accordance with the flat cable (100) it becomes possible to connect as electrically to between any of the piercing terminals (20) and any of the electrically conductive flat bodies for wiring (102), by fitting any of the piercing terminals (20) in to a vicinity of an end part of the flat cable (100).

Moreover, only a part of the flat insulating body (101) in a vicinity of which the piercing terminal (20) is fitted thereinto is designed to be remained in order to perform a sheath for the electrically conductive flat body for wiring (102), in the meanwhile, however, all the other part of the same are designed to be performed a trimming, that are shown in FIG. 2.

Further, the piercing terminal (20) is designed to be configured of: a part for setting in (22) of a concave shape; and a frame part (23) of a semicircular shape from a point of a cross sectional view that continues to the part for setting in (22) of the concave shape; and three pieces of the blades on the piercing terminal (21) that are designed to be arranged with having predetermined equal intervals respectively. Still further, the part for setting in (22) of the concave shape comprises a space for setting in (22A) that is designed in order to allow a part for setting in (22) of a convex shape of a terminal as a male type that is omitted to be shown in any of the drawings.

Still further, each of the blades on the piercing terminal (21) has a lateral face (21A), that is parallel to the length direction (X) and to the piercing direction (Z) which is piercing through the flat cable (100), and the same is formed to have a thin plate form of approximately a hairpin shape as a convex shape in a downward direction from a point of view of a lateral face. Still further, the blades on the piercing terminal (21) are designed to be aligned as one queue in the length direction (X) at a bottom end of the frame part (23), that are designed to be arranged at the three parts with the having predetermined equal intervals respectively.

Still further, the length direction (X) that is mentioned above is defined to be as a length direction for the piercing terminal (20) and for the flat cable (100) as well that is designed to connect the piercing terminal (20). Still further, the piercing direction (Z) that is mentioned above is defined to be as a direction in which each of the blades on the piercing terminal (21) is designed to piece through the flat cable (100), that is to say, the same is defined to be as a direction for a thickness of the flat cable (100).

And thus in accordance with the piercing terminal (20), it becomes possible to form as compactly in the cross direction (Y) regarding the piercing terminal (20) by designing to arrange three pieces of the individual blades on the piercing terminal (21) in the length direction (X) that are designed to be formed in the thin plate form and each of which has the lateral face (21A) as approximately parallel to the length direction (X) and to the piercing direction (Z) respectively. Furthermore, the flat cable (100) is designed to be formed as compactly in the cross direction (Y) in the similar manner, which is designed in order to fit the piercing terminal (20) in.

Here as shown in FIG. 2, the holder for holding the piercing terminal (10) that is mentioned above comprises a concave part for setting in (that is omitted to be shown in any of the drawings) to which the frame part (23) of the piercing terminal (20) is designed to be set in at a side of a bottom face. And then in accordance with the holder for holding the piercing terminal (10) it becomes possible to install any of the piercing terminals (20) as an aspect in which the part for setting in (22) of the concave shape in the piercing terminal (20) that is set in the concave part for setting in is designed to be protruded from the lateral face (10A) that is mentioned above.

Moreover, at a bottom end of each of lateral faces (10B) at the left and the right sides of the holder for holding the piercing terminal (10) there is designed to be provided a hook for latching together (11) in order to latch with making use of a concave part for latching (41) that is designed to be provided at a lateral face (40A) of a holder for holding a plate (40) that will be described in detail later.

Further, a back up plate (30) is designed to be formed to be as a rectangular shape from a planar point of view with having a length as approximately equivalent to that of the frame part (23), and then the same is designed to arrange three of openings for insertion (31) in the length direction (X) that are designed to pierce through the back up plate (30) respectively, that are shown in FIG. 2 and in FIG. 3. Still further, each of the openings for insertion (31) is designed to be as an open hole having a rectangular shape from a planar point of view that is designed to be arranged with having the predetermined interval in the length direction (X) as similar to that for each of the blades on the piercing terminal (21) respectively.

Still further, each of the openings for insertion (31) is designed to be formed with having a rectangular shape from a planar point of view that has a size in order to comprise a predetermined gap at the opposite side that corresponds to the side for contact of the individual blades on the piercing terminal (21) under the state where any of the individual blades on the piercing terminal (21) is inserted into the individual corresponding openings for insertion (31), respectively, that is shown in FIG. 6. In other words, a planar shape of each of the openings for insertion (31) is designed to be formed into a shape that is larger in a thickness direction comparing to any of the individual blades on the piercing terminal (21). Still further, FIG. 6 is an explanatory drawing from a point of a bottom view for showing a state where a blade on a piercing terminal (21) is inserted into the opening for insertion (31).

Furthermore, a plurality of the openings for insertion (31) are designed to be arranged with being performed a staggered arrangement with having the predetermined spacing (w) in the cross direction (Y), that corresponds to each of the blades on the piercing terminal (21) which is piercing as a linear form through an approximate center of the electrically conductive flat body for wiring (102) in the cross direction (Y) respectively.

Figure 4:
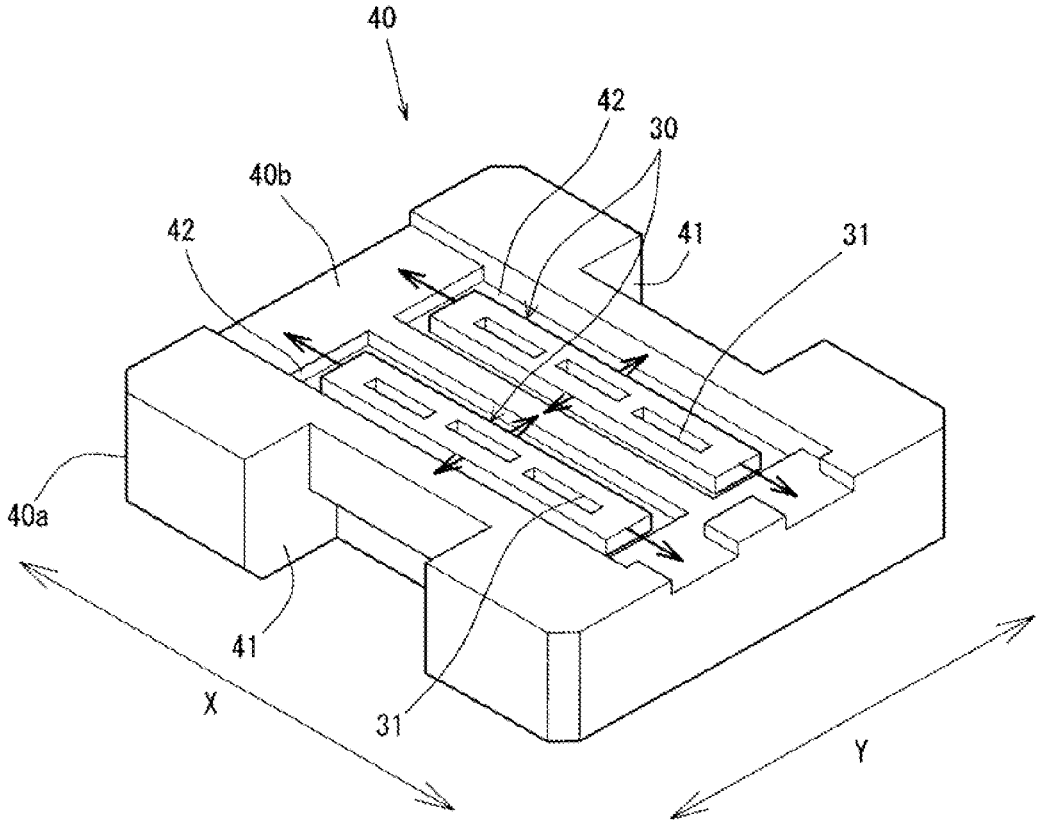
FIG. 4 is an explanatory drawing showing a state of which a piercing terminal is fitted with making use of a back up plate.

Next, the above mentioned holder for holding the plate (40) is designed to arrange two of concave parts for installing (42) as parallel in the cross direction (Y) by which the back up plate (30) is designed to be installed to an upper face (40B), that is shown in FIG. 4. Moreover, the holding plate (40) is designed to be inserted into the opening for insertion (31) that is designed to be arranged at the center of each of the concave parts for installing (42) from the planar point of view respectively. And then the same is designed to provide a tamper-proof concave part (43) in order to prevent from an end part of each of the blades on the piercing terminal (21) that is protruding in a downward direction from the side of the bottom face of each of the back up plates (30) respectively.

Further, FIG. 4 is an explanatory drawing from a point of a diagrammatic perspective view to explain by making use of the diagrammatic perspective view from the side of the bottom face of the flat cable (100) for showing a state of which a piercing terminal (20) is fitted with making use of a back up plate (30).

Figure 5:
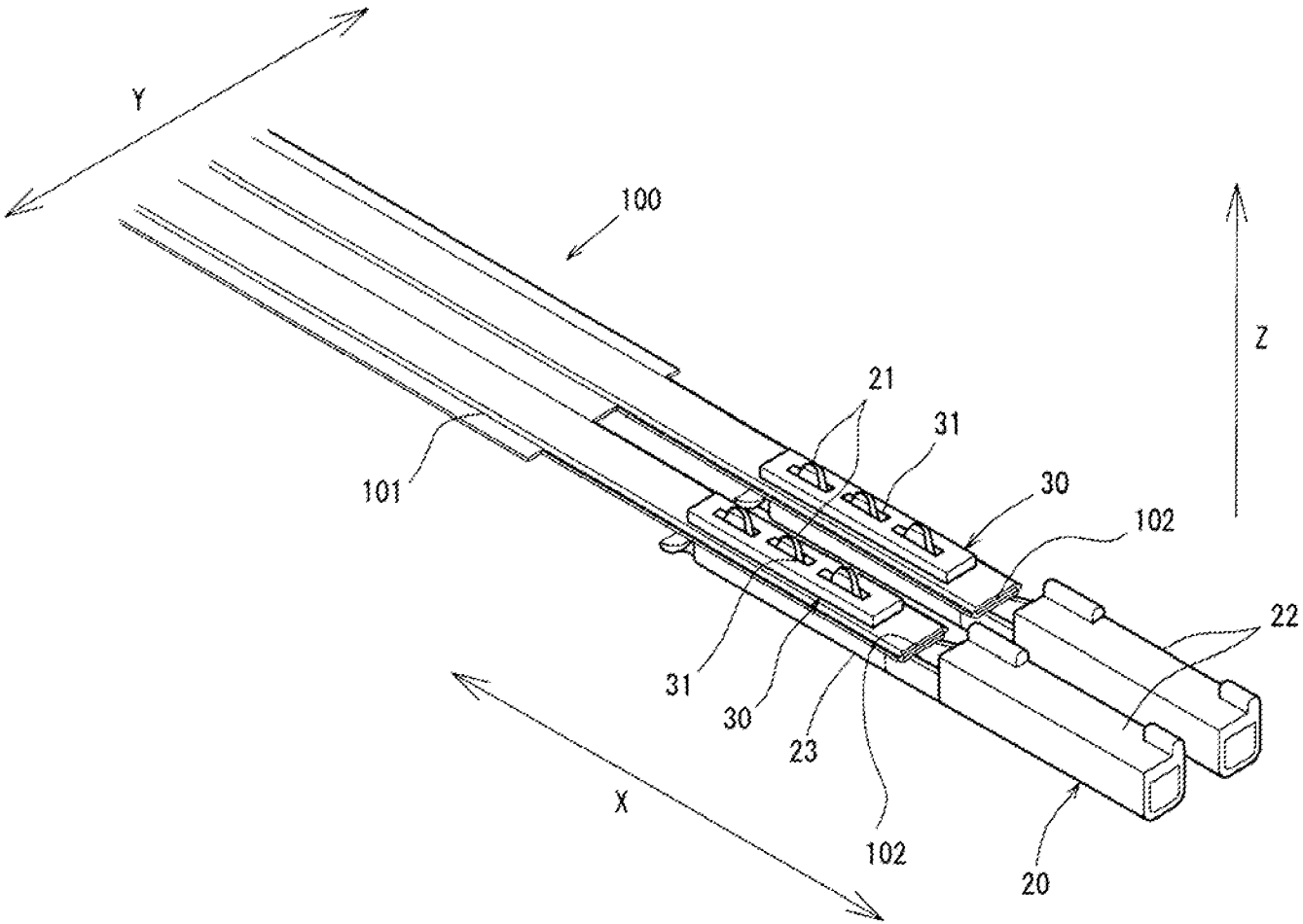
FIG. 5 is an explanatory drawing from a point of a diagrammatic perspective view showing a state of holding a back up plate regarding a holder for holding the plate.

Still further, each of such the concave parts for installing (42) is designed to be formed as slightly larger in every dimension comparing to the every corresponding dimension from a planar point of view of the back up plate (30) in order to design such the back up plate (30) that is fitted in to the corresponding concave part for installing (42) to be movable in the length direction (X) and in the cross direction (Y) as well, that is to say, in order to design such the opening for insertion (31) to be movable in a direction as a right angle to the piercing direction (Z) that is piercing through the flat cable (100), that are shown in FIG. 5.

Still further, there is designed for the holder for holding the plate (40) to provide the above mentioned concave part for latching (41) in a vicinity of the center of each of the lateral faces (40A) at the both sides in the cross direction (Y) of the holder for holding the plate (40) by which the hook for latching together (11) of the holder for holding the piercing terminal (10) is designed to be latched. Furthermore, FIG. 5 is an explanatory drawing from a point of a diagrammatic perspective view for showing a state of fitting a back up plate (30) regarding a holder for holding a plate (40).

And then it becomes possible to configure the unit for connecting the piercing terminal (1) by assembling the holder for holding the piercing terminal (10) and the piercing terminal (20) and the back up plate (30) and the holder for holding the plate (40) that are designed to be configured in manner. And thus it becomes possible to fit any of the piercing terminals (20) in to the flat cable (100) by making use of the unit for connecting the piercing terminal (1) that is assembled in the manner.

Next is regarding a method of connecting the piercing terminals (20) by making use of the unit for connecting the piercing terminal (1) in accordance with the present invention, that will be described in detail below. And in the first instance, the piercing terminals (20) in which there is designed to be provided a plurality of the blades on the piercing terminal (21) that is piercing through the flat cable (100) is designed to be performed a process of being fitted in to a concave part for setting in at a side of the bottom face of the holder for holding the piercing terminal (10), that is omitted to be shown in any of the drawings.

And then the back up plate (30) that comprises the opening for insertion (31) by which the insertion of any of the blades on the piercing terminal (21) that is designed to pierce through the flat cable (100) is allowed is designed to be performed a process of being fitted in to the concave part for installing (42) of the holder for holding the plate (40) in order to hold the back up plate (30) to be as movable in the directions as right angle to the piercing direction (Z).

Moreover, the flat cable (100) is designed to be performed a process of being inserted in to between the holder for holding the piercing terminal (10) and the holder for holding the plate (40). And then the holder for holding the piercing terminal (10) and the holder for holding the plate (40) are designed to be performed a process of being set in each other by latching the hook for latching together (11) on to the concave part for latching (41).

And thus it becomes possible to fit the unit for connecting the piercing terminal (1) in to the flat cable (100), which is shown in FIG. 1. Moreover, it becomes possible to perform a process for the blade on the piercing terminal (21) to pierce through the electrically conductive flat body for wiring (102) by performing a process of setting in together the holder for holding the piercing terminal (10) in which the piercing terminals (20) is installed and the holder for holding the plate (40) in which the back up plate (30) that is mentioned above is installed. And then thereafter each of the blades on the piercing terminal (21) that are piercing therethrough is designed to be performed a process of being inserted into the individual corresponding openings for insertion (31) of the back up plate (30), and thus it becomes possible to perform a process of connecting the piercing terminals (20) to the flat cable (100).

Further, it becomes possible to prevent any of the blades on the piercing terminal (21) that is inserted thereinto from being slipped out from the individual corresponding openings for insertion (31) due to a frictional resistance that is occurred due to a contact of between the lateral face (21A) and the opening for insertion (31), because two of the lateral faces (21A) that are facing to each other of the blades on the piercing terminal (21) that are individually inserted into the individual corresponding openings for insertion (31) and each of the individual corresponding openings for insertion (31) are designed to be contacted to each other.

That is to say, it becomes possible to perform a process of connecting such the piercing terminals (20) without bending any of the blades on the piercing terminal (21) that are piercing through the electrically conductive flat body for wiring (102). And therefore it becomes possible to perform the process in order to connect the piercing terminals (20) to the electrically conductive flat body for wiring (102) with omitting a process of bending work on any of the blades on the piercing terminal (21). Still further, in accordance with the processes it becomes possible to improve a reliability regarding a connection of the piercing terminals (20) to the electrically conductive flat body for wiring (102).

Still further, it becomes able to realize a prevention of any of the blades on the piercing terminal (21) from being slipped out therefrom by making use of the frictional resistance that is occurred at the parts as not less than two of which each of the blades on the piercing terminal (21) are facing each other that are inserted into the individual corresponding openings for insertion (31). And therefore it becomes possible to prevent as assuredly any of the blades on the piercing terminal (21) from being slipped out therefrom because the frictional resistance becomes to function as balanced well.

Still further, it becomes possible to ensure a contact area, because either one face of each of the blades on the piercing terminal (21) and the inner side face (31B) of the opening for insertion (31) become to be contacted due to the arrangement of a plurality of the blades on the piercing terminal (21) in the length direction (X) that are individually formed into a thin plate form and that individually have the lateral faces (21A) as approximately parallel to the length direction (X) and to the piercing direction (Z). And therefore it becomes possible to function as assuredly the frictional resistance at each of the parts for contacting to therebetween, and then it becomes possible to prevent as assuredly any of the blades on the piercing terminal (21) from being slipped out therefrom as well.

Still further, it becomes possible to design for any of the blades on the piercing terminal (21) to pierce through toward the side of the bottom face of the flat cable (100) by performing a process of setting in the holder for holding the piercing terminal (10) on which the piercing terminal (20) is installed together with the holder for holding the plate (40) that is mentioned above and on which the back up plate (30) is installed at the concave pat for installing (42), and then it becomes possible to perform a process of inserting any of the blades on the piercing terminal (21) into the individual corresponding openings for insertion (31), that pierce through toward the side of the bottom face of the flat cable (100).

Still further, in accordance with the holder for holding the plate (40) it becomes possible to maintain the back up plate (30) that is mentioned above to be as movable in the direction as right angle to the piercing direction (Z) that is mentioned above. And therefore it becomes possible to perform a process of moving the back up plate (30) and then to perform a process of guiding any of the blades on the piercing terminal (21) and then to perform a process of inserting into the individual corresponding openings for insertion (31) as easily and as assuredly even in a case where a positioning in a planar point of view for between any of the blades on the piercing terminal (21) and the opening for insertion (31) is shifted at a time of setting in the holder for holding the piercing terminal (10) together with the holder for holding the plate (40).

Figure 6A:
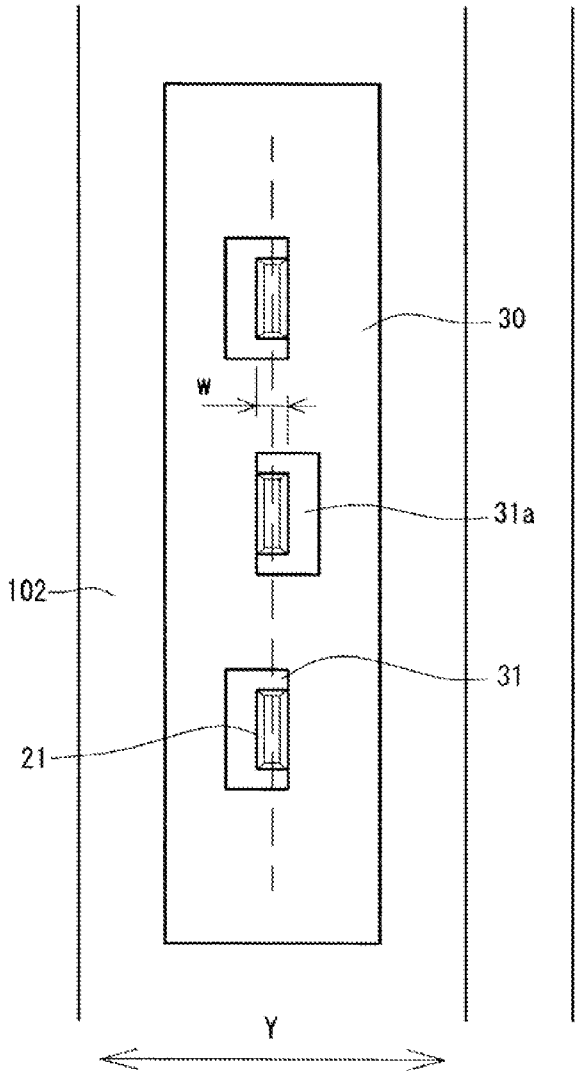
FIGS. 6A & 6B are explanatory drawings showing a state of inserting a blade on a piercing terminal into an opening for insertion regarding a back up plate.

Still further, each of the openings for insertion (31) is designed to be formed with having the shape that comprises a predetermined gap (31A) at an opposite side that corresponds to the side for contact of the individual blades on the piercing terminal (21) under the state where any of the individual blades on the piercing terminal (21) is inserted into the individual corresponding openings for insertion (31) respectively, that is shown in FIG. 6A. And therefore even in the case where the positioning for inserting any of the blades on the piercing terminal (21) into the individual corresponding openings for insertion (31) is shifted at the time of setting in the holder for holding the piercing terminal (10) together with the holder for holding the plate (40), that is to say, even in the case where there occurred an error on the positioning for inserting, it becomes possible to perform the processes due to the predetermined gap (31A) with absorbing any of the error. Still further, it becomes possible to perform a process of moving the back up plate (30) at an inner side of the concave part for installing (42), and then it becomes possible to perform as easily a process of inserting any of the blades on the piercing terminal (21) into the individual corresponding openings for insertion (31), that are shown in FIG. 4.

Still further, it becomes possible to function as assuredly the frictional resistance that is occurred at the parts as not less than two of which each of the blades on the piercing terminal (21) are facing each other that are inserted into the individual corresponding openings for insertion (31) respectively, and then it becomes possible to prevent any of the blades on the piercing terminal (21) from being slipped out therefrom as well, because a plurality of the openings for insertion (31) that are designed to be arranged in the length direction (X) are further designed to be performed a process of arranging to be staggered with the predetermined spacing (w) in the cross direction (Y) respectively.

As more specifically, any of the blades on the piercing terminal (21) that is piercing through the flat cable (100) is designed to be performed a process of inserting into the individual corresponding openings for insertion (31), and then it becomes possible to contact the inner side face (31B) at the right side of the opening for insertion (31) as an upper stage to the corresponding lateral face (21A) of one of the blades on the piercing terminal (21), in the meantime, it becomes possible to contact the inner side face (31B) at the left side of the opening for insertion (31) as a middle stage to the corresponding lateral face (21A) thereof, and then in the meantime, it becomes possible to contact the inner side face (31B) at the right side of such the opening for insertion (31) as a lower stage to the corresponding lateral face (21A) thereof, that are shown in FIG. 6A.

Figure 7:
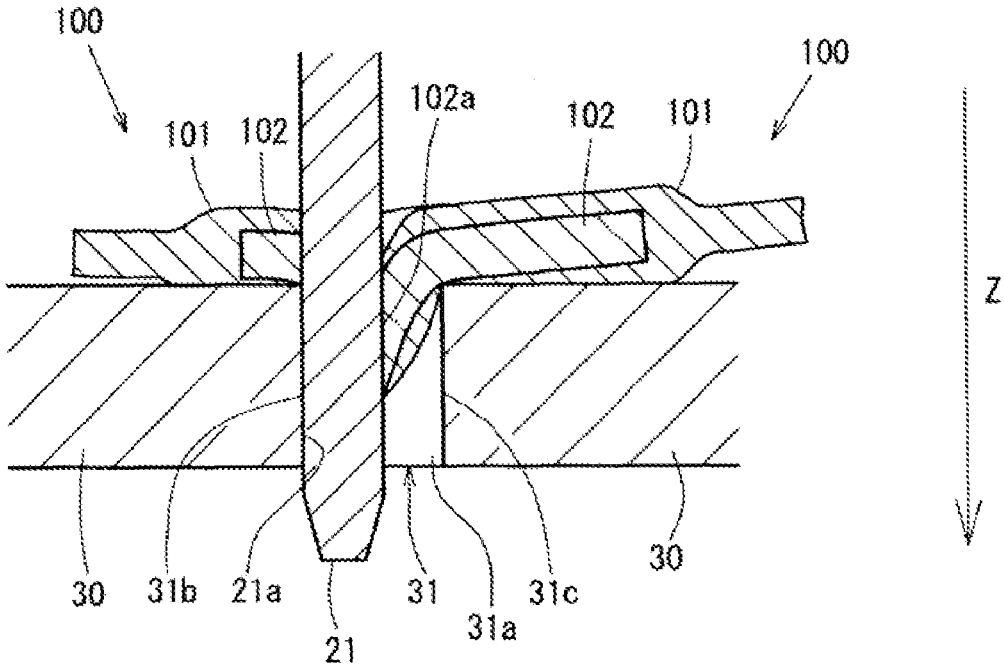
FIG. 7 is a cross sectional view explanatorily showing with enlarging a cross section for a piercing of a blade on a piercing terminal through a flat cable.

And thus the lateral faces (21A) of any of the blades on the piercing terminal (21) as not less than two that are facing to each other are designed to be contacted to the inner side face (31B) of the individual corresponding openings for insertion (31), and then it becomes possible to prevent any of the blades on the piercing terminal (21) that is mentioned above and that is inserted thereinto from being slipped out from the individual corresponding openings for insertion (31) due to the frictional resistance that is occurred due to the contact to each other of between each of the lateral faces (21A) and the individual corresponding openings for insertion (31), that are shown in FIG. 7. That is, it becomes possible to perform a process of mounting any of the piercing terminals (20) on to the flat cable (100) without bending any of the blades on the piercing terminal (21) that are piercing through the electrically conductive flat body for wiring (102).

And therefore it becomes possible to perform the process in order to form as compactly in the cross direction (Y) regarding the piercing terminals (20) and the flat cable (100) on which any of the piercing terminals (20) is mounted. And therefore it becomes available as preferred to apply to a connection of between the electronic parts and components for which a smaller in size is required. Still further, it becomes possible to omit the process of bending work on any of the blades on the piercing terminal (21) regarding the process in order to connect any of the piercing terminals (20) to the flat cable (100). Still further, it becomes possible to improve the reliability regarding the connection of any of the piercing terminals (20) to the flat cable (100) in accordance with the processes.

Still further, the back up plate (30) is designed to be performed the process of being arranged at the side of the bottom face of the flat cable (100) at the time when any of the blades on the piercing terminal (21) pierce through the flat cable (100). And then thereby becoming the electrically conductive flat body for wiring (102) to be sheared and then to be ruptured at the side where any of the blades on the piercing terminal (21) and the individual corresponding openings for insertion (31) are contacted to each other, due to the insertion of any of the blades on the piercing terminal (21), that is shown in FIG. 7.

Furthermore, the electrically conductive flat body for wiring (102) at an opposite side where the predetermined gap (31A) is designed to be provided to perform a process of stretching and then of rupturing on the contrary due to the insertion of any of the blades on the piercing terminal (21) for which an upper end of an inner side face (31C) is designed to be as a fulcrum, because of the predetermined gap (31A) is designed to be provided therebetween. Here FIG. 7 is a cross sectional view for explanatorily showing with enlarging a cross section for a piercing of a blade on a piercing terminal (21) through a flat cable (100).

And then in accordance with the processes, an end face to be ruptured (102A) that is performed the process of stretching and then of rupturing due to the insertion of any of the blades on the piercing terminal (21) becomes to be further performed a process of contacting as assuredly to a lateral face (21A) of such the blade on the piercing terminal (21). And thus it becomes possible to connect as assuredly to each other between a piercing terminal (20) and an electrically conductive flat body for wiring (102) via the blade on the piercing terminal (21).

Figure 6B:
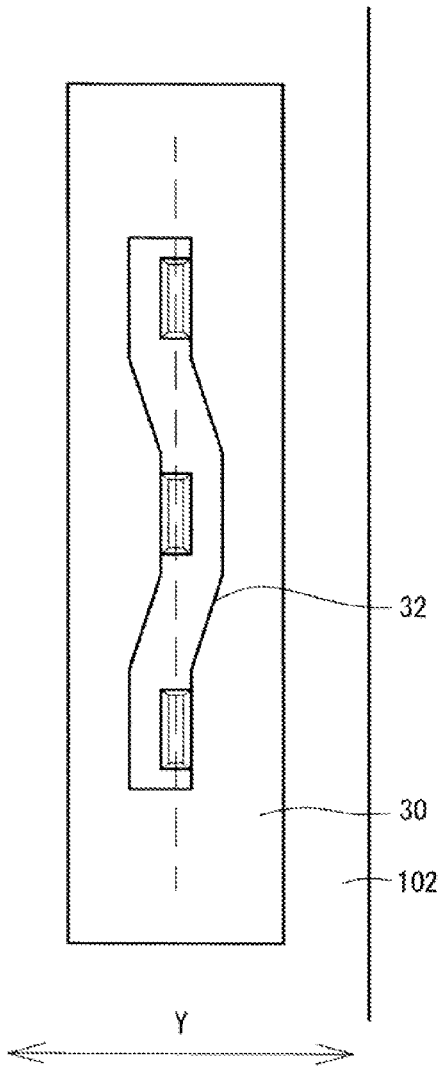

Moreover, in accordance with the present embodiment, three pieces of the blades on the piercing terminal (21) that are aligned on a straight line in the length direction (X) are designed to be performed a process of inserting into three of the individual corresponding openings for insertion (31) that are performed a staggered arrangement of shifting to the left or to the right as alternately with having the predetermined spacing (w) respectively, that is shown in FIG. 6A. And then each of the blades on the piercing terminal (21) is designed to be performed a process of contacting to each of the individual corresponding openings for insertion (31) at a part that is facing to the other piece of the blades on the piercing terminal (21) in order to prevent any of the blades on the piercing terminal (21) from being slipped out from each of the individual corresponding openings for insertion (31), due to the frictional resistance that is occurred at each of the parts for contacting to each other. Or in the meantime, however, it may be available to design to configure with making use of a continuous opening for insertion (32) as just one piece that is continuous as a shape of wave from a planar point of view for each of the lateral faces(21A) of the individual blades on the piercing terminal (21) that is contacting to be arranged as alternately at the left side or at the right side respectively, that is shown in FIG. 6B, in place of designing to provide a plurality of the openings for insertion (31).

Figure 8A:
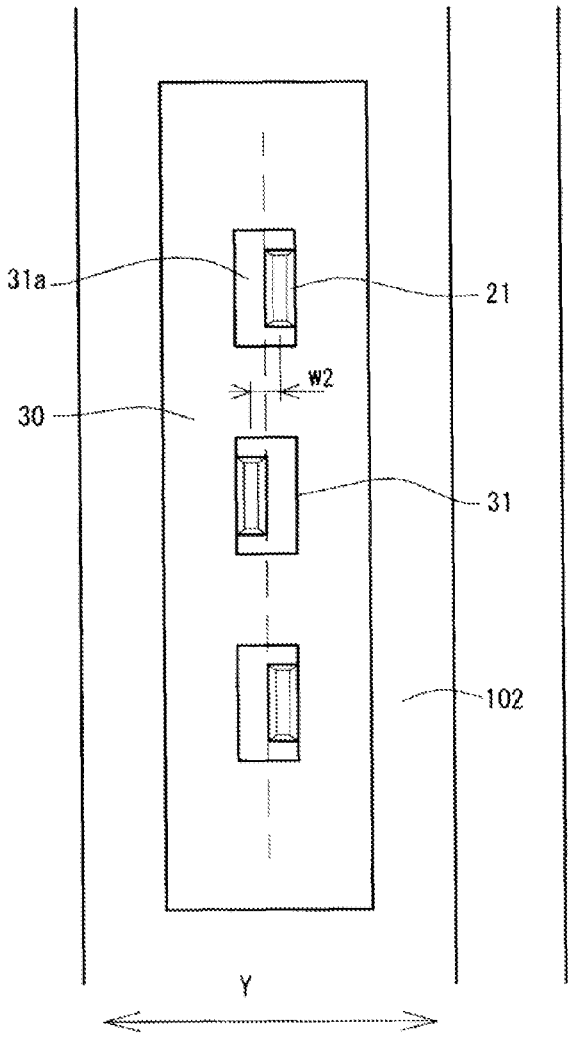
FIGS. 8A & 8B are explanatory drawings showing a state of inserting a blade on a piercing terminal into an opening for insertion regarding a back up plate in accordance with another embodiment.

Further, it may be available to design to arrange any of the openings for insertion (31) on a straight line in the length direction (X), that is shown in FIG. 8A. And then in the case it may be available to design to arrange any of the blades on the piercing terminal (21) with shifting as alternately with a predetermined spacing (w2) in the cross direction (Y) respectively, that is to say, it may be available to design for the same to be performed a staggered arrangement, in order to obtain a contact which is to the inner side face of the individual corresponding openings for insertion (31) that are designed to be arranged in a straight form to be as alternately at the left side or at the right side respectively.

And then in accordance with such manner it becomes possible to perform a process of contacting each of the lateral faces (21A) of the individual blades on the piercing terminal (21) that are provided as three pieces in the length direction (X) as alternately at the left side or at the right side to the individual corresponding inner side faces at the right side or at the left side of the individual corresponding openings for insertion (31). And hence in accordance with the contact of the faces to each other it becomes possible to prevent any of the blades on the piercing terminal (21) from being slipped out from the individual corresponding openings for insertion (31).

Figure 8B:
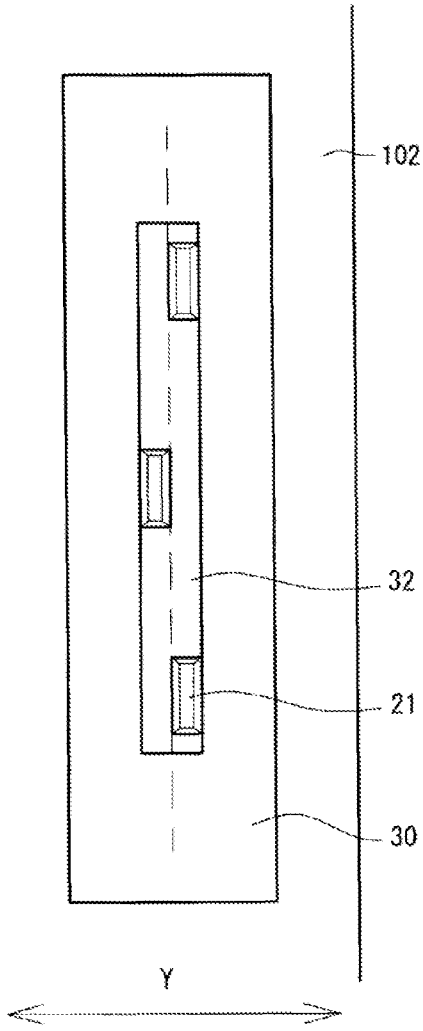

Still further, it may be available to design to perform a process by making use of a continuous opening for insertion (32) that is designed to be formed in a slit shape as a letter of (I) from a planar point of view and that is designed to have a thickness as approximately two times as the thickness in the cross direction (Y) regarding each of the blades on the piercing terminal (21), that is shown in FIG. 8B. And then even in accordance with the continuous opening for insertion (32) that is designed to be formed in the slit shape as the letter of (I) from a planar point of view, it becomes possible to obtain an advantage which is similar to that in accordance with the case where each of the openings for insertion (31) is designed to be performed the staggered arrangement.

Figure 9A:
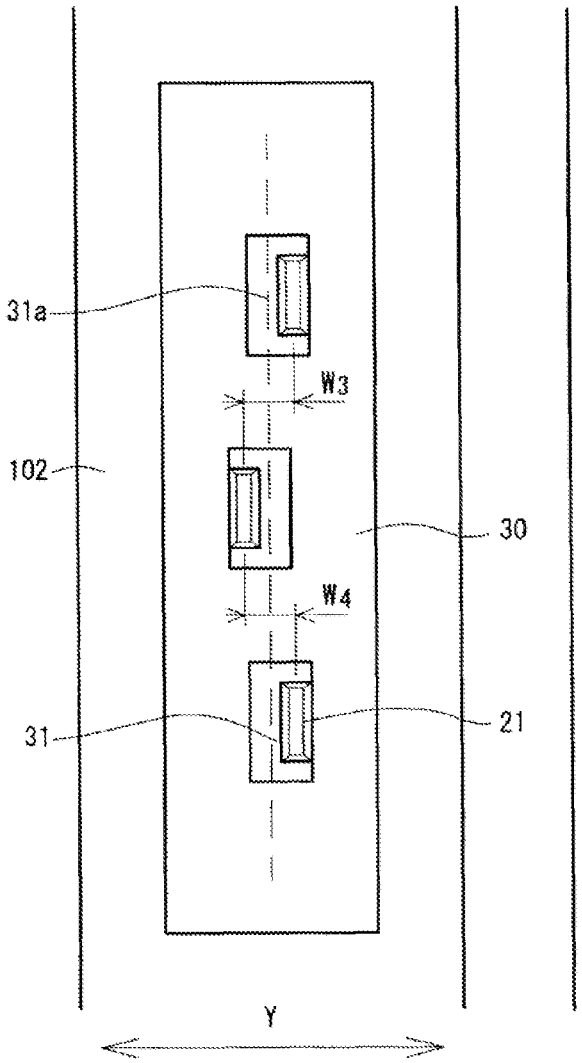
FIGS. 9A & 9B are explanatory drawings showing a state of inserting a blade on a piercing terminal into an opening for insertion regarding a back up plate in accordance with further another embodiment.
Figure 9B:
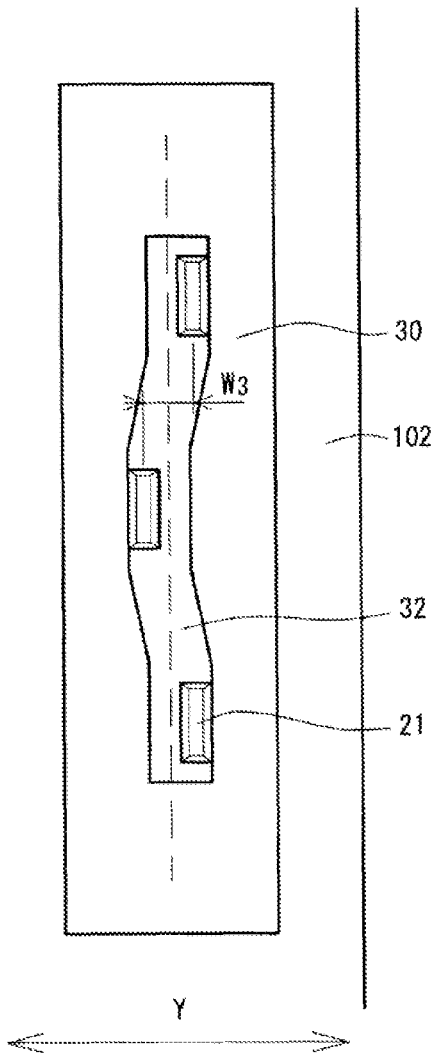

Still further, it may be available to design any of the blades on the piercing terminal (21) and any of the opening for insertion (31) to be individually arranged with shifting a predetermined spacing (w3) as alternately and with shifting a predetermined spacing (w4) as alternately in the cross direction (Y) respectively, that is shown in FIG. 9A. Still further, it may be available to design for any of the blades on the piercing terminal (21) to be performed a staggered arrangement with shifting a predetermined spacing (w3) as alternately in the cross direction (Y) respectively, and then to design for any of the blades on the piercing terminal (21) that is performed the staggered arrangement to be further performed a process of inserting into a continuous opening for insertion (32) as just one piece that is designed to be continuous as a shape of wave from a planar point of view and that is contacting to each part of the individual corresponding blades on the piercing terminal (21) that are facing each other, and thus it may be available to configure in the manner that is shown in FIG. 9B.

Figures 10A, 10B:
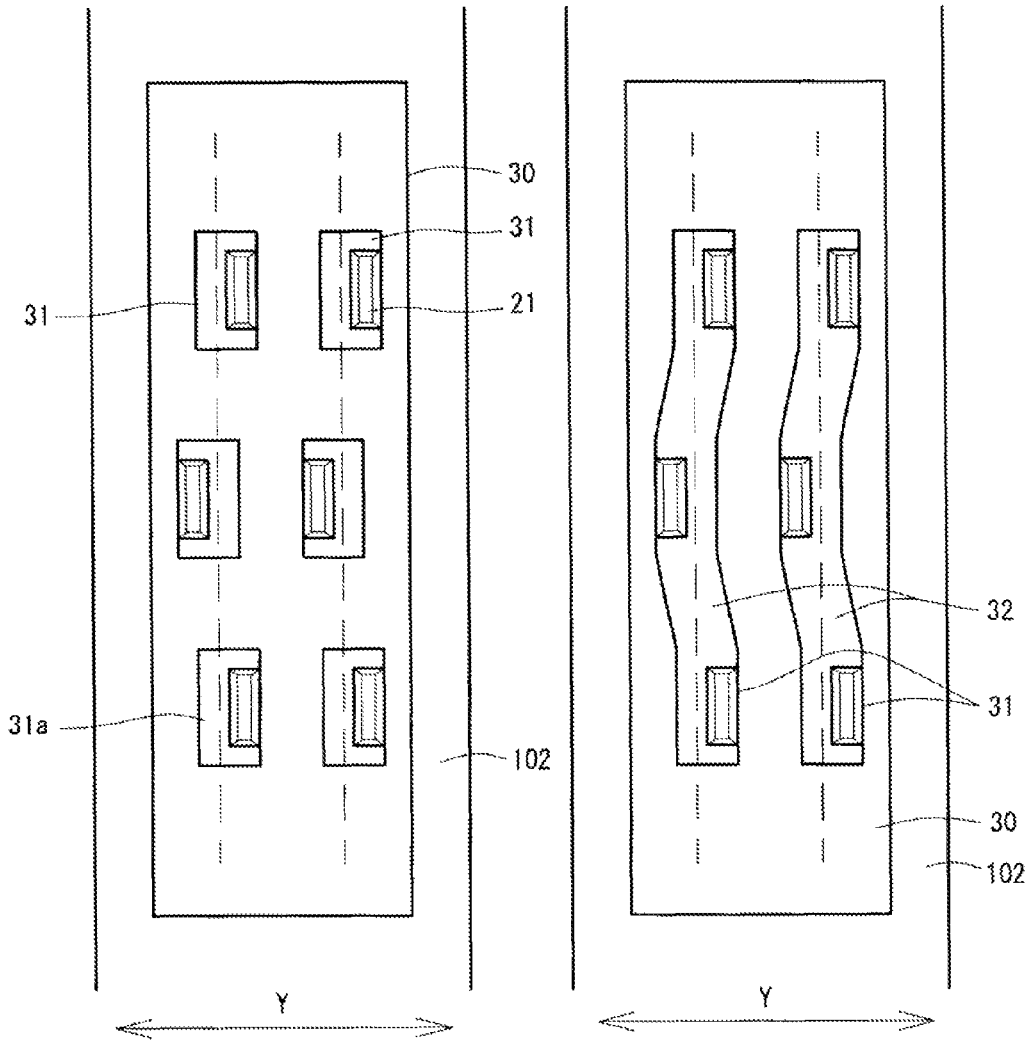
FIGS. 10A & 10B are explanatory drawings showing a state of inserting a blade on a piercing terminal into an opening for insertion regarding a back up plate in accordance with still further another embodiment.

Still further, it may be available to design to arrange any of the blades on the piercing terminal (21) as two lines in the cross direction (Y) and then to design to perform a staggered arrangement for each of the blades on the pierced terminal (21) at the left side or at the right side in a case where it is required to ensure a contact area as larger for contacting to the flat cable (100), that is shown in FIG. 10. Furthermore, it may be available to design to perform a staggered arrangement for any of the openings for insertion (31) that corresponds to the individual blades on the piercing terminal (21) as two queues on two of individual straight lines, respectively.

Here in accordance with the present embodiment the parts for contacting to between any of the piercing terminals (20) and the back up plate (30) are designed to be performed the sheath with making use of the holder for holding the piercing terminals (10) and the holder for holding the plate (40). In the meantime, however, it may be available to design a configuration in which there is designed to be performed a sheath therefor that includes a part for setting in (22) of a concave shape and a flat cable (100), with making use of a holder for holding a pierced terminals (10) and a holder for holding a plate (40).

Moreover, in accordance with the present embodiment there is designed to be made use of the flat cable (100) in which all the other parts of the flat insulating body (101) are designed to be performed the trimming except the part for performing the sheath for any of the electrically conductive flat bodies for wiring (102) in the vicinity of the parts that are designed to install any of the piercing terminals (20). In the meantime, however, it may be available to dismount all of the flat insulating bodies (101) in a vicinity of an end part of the flat cable (100), and then it may be available to install a piercing terminal (20) under a state where an electrically conductive flat body for wiring (102) is designed to be exposed. Further, in accordance with the present embodiment the flat cable (100) is designed in which the two pieces of the electrically conductive flat bodies for wiring (102) are designed to be arranged. In the meantime, however, it may be available to design for a flat cable (100) as well in which electrically conductive flat bodies for wiring (102) as not less than two pieces are designed to be provided.

Furthermore, regarding a correspondence to between the configuration in accordance with the present invention and the embodiment that is described in detail above, an electrically conductive flat square body in accordance with the present invention corresponds to the electrically conductive flat body for wiring (102), and in the same way hereinafter:

- a piece for piercing corresponds to the blade on the piercing terminal (21);
- a connecting terminal corresponds to the piercing terminal (20);
- an opening for insertion corresponds to the opening for insertion (31) or to the continuous opening for insertion (32);
- a plate corresponds to the back up plate (30);
- a face that is approximately parallel to the length direction and to the piercing direction corresponds to the lateral face (21A);
- a holder for holding a connecting terminal corresponds to the holder for holding a piercing terminal (10); and
- a direction as right angle to the piercing direction corresponds to the length direction (X) and to the cross direction (Y).

In the meantime, however, the present invention will not be limited only to the configuration in accordance with the embodiment that is described in detail above, and then it becomes able to obtain a variety of other embodiments as well.

What is claimed is:

1. A connection structure of a connecting terminal, comprising:

a connecting terminal, in which a plurality of pieces for piercing individually pierce through an electrically conductive flat body, and which is connected electrically to said electrically conductive flat body due to each of said pieces for piercing that is piercing therethrough;

a plate that comprises an opening for insertion into which an insertion of any of said pieces for piercing is allowed that is piercing through said electrically conductive flat body, wherein said opening for insertion contacts individual lateral faces on said individual corresponding pieces for piercing; and a holder for holding the plate that is removable in a right angle direction to a piercing direction.

2. The connection structure of the connecting terminal according to claim 1, wherein each of said pieces for piercing is formed into a shape of a thin plate that has a face as approximately parallel in a length direction and in the piercing direction, and a plurality of said pieces for piercing are arranged in said length direction, and a face of said piece for piercing contacts a face at an inner side of said opening for insertion.

3. The connection structure of the connecting terminal according to claim 2, wherein said pieces for piercing are inserted into said opening for insertion and a predetermined gap is formed at an opposite side of the face that contacts the inner side of the opening for insertion.

4. The connection structure of the connecting terminal according to claim 2 or 3, wherein a plurality of said pieces for piercing that are arranged in said length direction and/or said openings for insertion that individually correspond to each of said pieces for piercing are staggered having a predetermined spacing in a cross direction.

5. The connection structure of the connecting terminal according to claim 1, further comprising:

a holder for holding the connecting terminal in order to hold the connecting terminal, wherein said holder for holding the connecting terminal and said holder for holding said plate are set in each other by arranging said electrically conductive flat body therebetween.

6. A method of connecting the connecting terminal, comprising the steps of:

utilizing a connecting terminal, in which a plurality of pieces for piercing individually pierce through an electrically conductive flat body, and which is connected electrically to said electrically conductive flat body due to each of said pieces for piercing that is piercing therethrough, into a holder for holding the connecting terminal in order to hold said connecting terminal;

installing a plate near the connecting terminal, that comprises an opening for insertion into which an insertion of any of said pieces for piercing is allowed that is piercing through said electrically conductive flat body, into a holder for holding the plate that is removable in a right angle direction to a piercing direction; and setting in said holder for holding the connecting terminal into said holder for holding said plate by inserting said electrically conductive flat body between said holder for holding the connecting terminal and said holder for holding said plate, and then by arranging said electrically conductive flat body therebetween.

7. The connection structure of the connecting terminal according to claim 3, wherein a plurality of said pieces for piercing that are arranged in said length direction and/or said openings for insertion that individually correspond to each of said pieces for piercing are staggered having a predetermined spacing in a cross direction.

8. The connection structure of the connecting terminal according to claim 2, further comprising:

a holder for holding the connecting terminal in order to hold the connecting terminal, wherein said holder for holding the connecting terminal and said holder for holding the plate are set in each other by arranging said electrically conductive flat body therebetween.

9. The connection structure of the connecting terminal according to claim 3, further comprising:

a holder for holding the connecting terminal in order to hold the connecting terminal, wherein said holder for holding the connecting terminal and said holder for holding the plate are designed to be set in each other by arranging said electrically conductive flat body therebetween.

10. The connection structure of the connecting terminal according to claim 4, further comprising:

a holder for holding the connecting terminal in order to hold the connecting terminal, wherein said holder for holding the connecting terminal and said holder for holding the plate are set in each other by arranging said electrically conductive flat body therebetween.

* * * * *